US005934522A

United States Patent [19]

Canela et al.

[11] Patent Number: 5,934,522

[45] Date of Patent: Aug. 10, 1999

[54] ACCORDION SHAPED NECK FOR CONTAINERS

[76] Inventors: Heriberto Canela, 8027 W. 14th Ave., Hialeah, Fla. 33014; Carlos M. Mendez, 2401 N. Bendugo Rd., Glendale, Calif. 91208

[21] Appl. No.: 09/062,419

[22] Filed: Apr. 17, 1998

[51] Int. Cl.[6] ..... B67D 3/00

[52] U.S. Cl. ..... 222/527; 222/526; 222/528; 222/529; 222/530; 222/547; 222/564; 141/337

[58] Field of Search ..... 222/527, 528, 222/529, 530, 547, 564; 141/337

[56] References Cited

U.S. PATENT DOCUMENTS

| | | | |
|---|---|---|---|
| 3,193,154 | 7/1965 | Bross | 222/529 |
| 4,602,728 | 7/1986 | Ha | 222/530 |
| 5,020,702 | 6/1991 | James | 222/529 |

*Primary Examiner*—David J. Walczak
*Assistant Examiner*—Timothy L. Maust
*Attorney, Agent, or Firm*—Herberto Canela; Juan Carlos Mendez

[57] ABSTRACT

A flexible elongated tubular neck having an accordion shape that is rigidly mounted to a container containing liquids, and having an upper opening, that permits a user to readily pour out the content into a reservoir without the need of a funnel and without the risk of spillage. This elongated tubular accordion shaped neck has a threaded tubular end to cooperatively receive a threaded cap thereto, and also has sufficient length so that a user can extend it and locate the threaded tubular end next to a reservoir so that the liquid content can be transferred from the container to another reservoir. The elongated tubular accordion shaped neck includes locking means mounted to its internal wall, wherein the locking means includes a plurality of plates radially and inwardly extended, and at least one protuberance and a cavity in coaxial alignment with respect to each other. When the accordion shaped neck is in compressed position, the protuberances engage within the cavities located in another adjacent plate.

1 Claim, 3 Drawing Sheets

ACCORDION SHAPED NECK FOR CONTAINERS

BACKGROUND OF THE INVENTION

1. Field of the Invention

The present invention relates to an elongated tubular neck for containers, and more particularly, to the type that has a flexible accordion shape.

2. Description of the Related Art

Millions of users in the automobile industry use different size containers, containing oil, anti-freeze liquid and other chemical liquids, for their vehicles. Frequently, a funnel is needed to aid a user in pouring out the oil, or other liquid, in from the container into the engine of the vehicle, or other reservoir. Notwithstanding this need, many times the funnel is not at hand and a user spills out a considerable amount of the oil or other liquid while she/he is transferring the content form one container to another. This undesirable situation is harmful for our environment, not to mention the inconvenience for the user. The present invention overcomes this shortcoming by disclosing an elongated tubular flexible accordion shaped neck that can be rigidly or removably mounted to the mouthpiece of a container. This permits a user to outwardly extend the neck and pour out the content directly into the desired reservoir without the need of a funnel. This invention also discloses a locking mechanism that is mounted inside the neck of a container and it is designed to seal the outlet of the container thus preventing the undesirable spillage of the oil and/or other chemical liquids to the ground. The disclosed locking mechanism is a security for our environment.

SUMMARY OF THE INVENTION

It is one of the main objects of the present invention to provide a flexible tubular neck having an accordion shape that is rigidly mounted to a container and that permits a user to readily pour out the content into a reservoir without the need of a funnel and without the risk of spillage.

It is another object of this invention to provide a flexible tubular accordion shaped neck that includes threaded ends so that it can be removably mounted to a threaded mouthpiece of a container.

It is still another object of the present invention to provide an elongated tubular neck that has a locking mechanism to prevent the content, such as oil, in a container from spillage.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
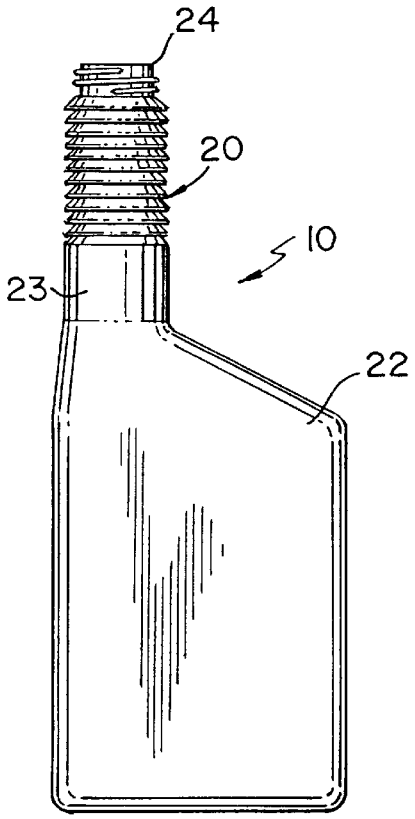
FIG. 1 is an elevational view of a container with an elongated accordion shaped neck in compressed position.

Referring now to the drawings, where the present invention is generally referred to with numeral 10, it can be observed that it basically includes elongated tubular neck 20 rigidly mounted, at one end, to opening 21 of container 22.

Figure 2:
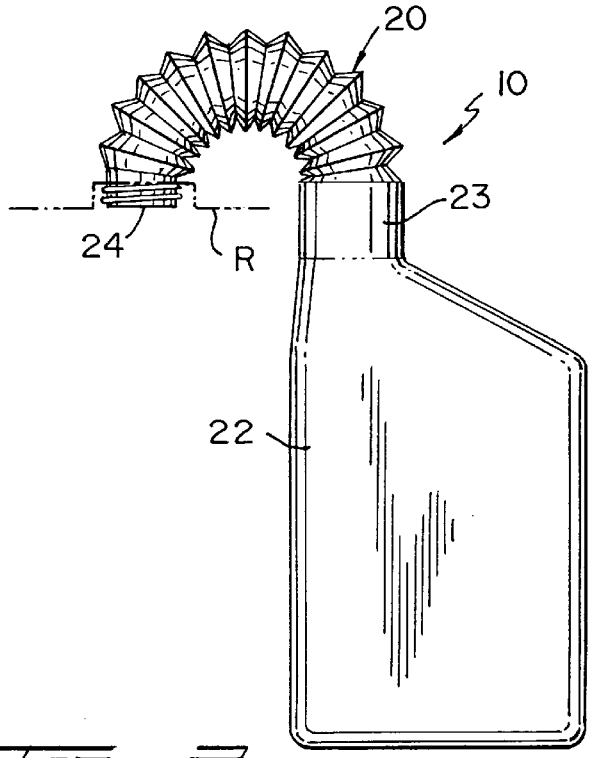
FIG. 2 is an elevational view of the container with the elongated accordion shaped neck in extended position. The mouthpiece of another container or reservoir R is shown in phantom.
Figure 3:
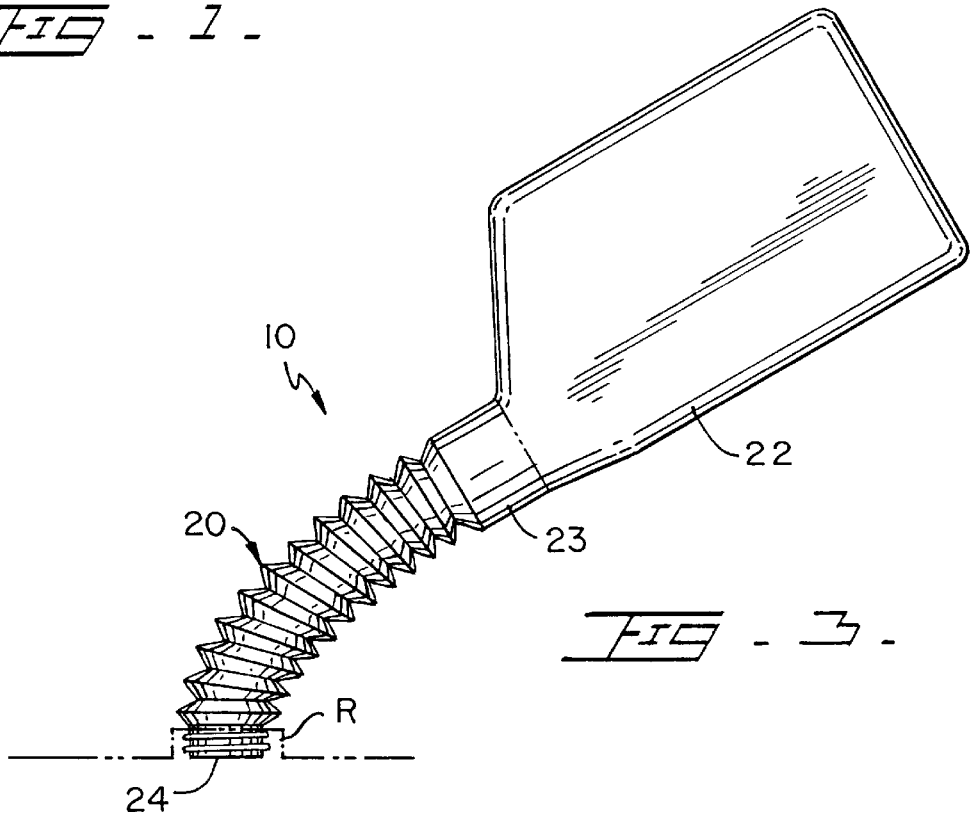
FIG. 3 is an elevational view of this invention shown in the previous figures, illustrating the container with the accordion shaped neck pouring the content into another reservoir.
Figure 6:
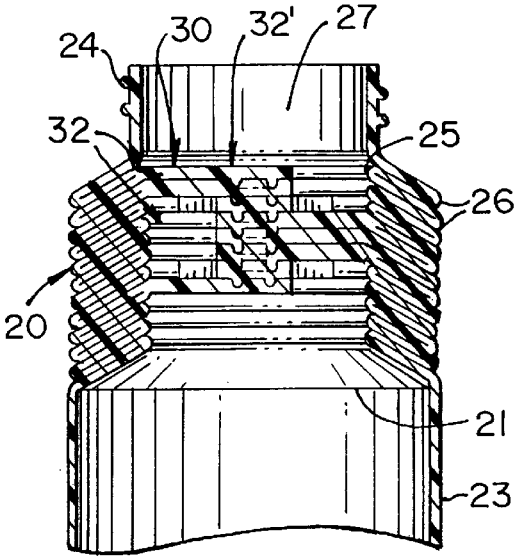
FIG. 6 is a partial elevational cross-sectional view of accordion shaped neck shown in FIGS. 4 and 5 but in compressed position.
Figure 5:
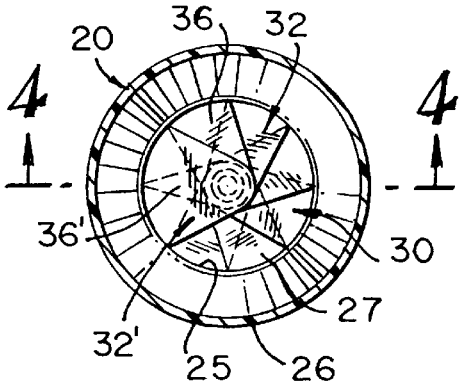
FIG. 5 is a top cross-sectional view of the accordion shaped neck showing a plurality of plates radially and centrally disposed, taken along line 5—5 in FIG. 4.

Elongated tubular neck 20 has an accordion shape and is preferably made out of a flexible plastic material. Elongated tubular neck 20 includes lower tubular portion 23 that is connected to container 22 and upper threaded tubular member 24. Upper threaded tubular member 24 is designed to cooperatively receives a cap (not shown in the drawings). FIGS. 1 and 6 illustrate container 22 with accordion shaped elongated tubular neck 20 in compressed position. When in use, a user extends accordion shaped elongated tubular neck 20 and positions upper threaded tubular member 24 into the mouthpiece or inlet of reservoir R in order to transfer the liquid content from container 22 to reservoir R, as best seen in FIGS. 2 and 3. In this manner, the risk of spillage of the content of container 22, such as oil, in the ground is minimized. Another advantage is that a funnel is not needed to aid a user to transfer the content from one reservoir to another.

Figure 4:
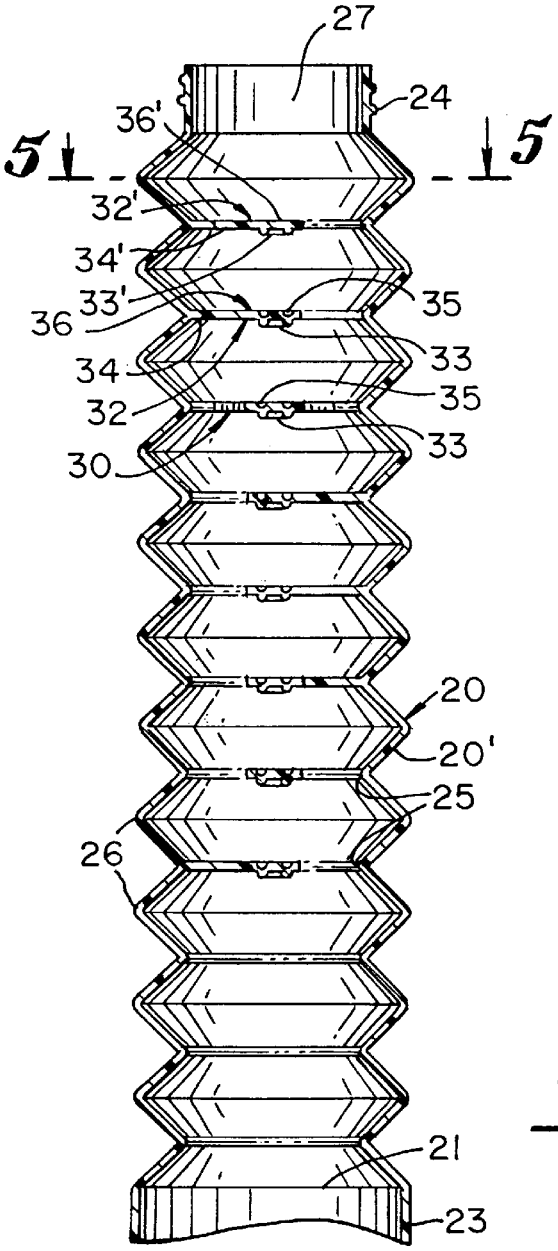
FIG. 4 is a partial elevational cross-sectional view of an elongated tubular neck having an accordion shape and showing a plurality of locking plates, taken along line 4—4 in FIG. 5. The neck is shown in extended position.

Elongated tubular neck 20 has locking assembly 30 mounted to its wall 20'. Locking assembly 30 includes a plurality of inwardly and radially extended plates 32 as shown in FIGS. 4; 5 and 6. Plates 32 are mounted to inner annular rims 25 which have a smaller diameter than outer annular rims 26, as shown in FIGS. 4 and 6. Plates 32 are disposed at a parallel and spaced apart relationship to each other when elongated tubular neck 20 is in extended position, as shown in FIG. 4. Plates 32 include protuberances 33 disposed in its lower surface 34 and cavities 35 in its upper surface 36. Protuberances 33 and cavities 35 are disposed in co-axial alignment so that protuberances 33 cooperatively engage with cavities 35 of next plate 32. In this manner, by engaging protuberances 33 of one plate 32 with cavities 35 of adjacent plate 32, plates 32 are kept together. This causes opening 27 to be closed thus preventing the contained liquid to flow through. In the preferred embodiment, upper plate 32' has flat lower surface 34' and upper surface 36'. Lower surface 34' includes protuberances 33' downwardly projected which engage with cavities 35 of adjacent plate 32, as illustrated in FIGS. 4 and 6.

When elongated tubular neck 20 is extended and falls in the ground after being used and partially emptied, plates 32 and upper plate 32' are brought together thereby preventing the residual content inside container 22 from flowing out through opening 27, even when a threaded cap is not mounted. This has the intention to protect the environment from undesirable spillage of chemical liquids.

Figure 7:
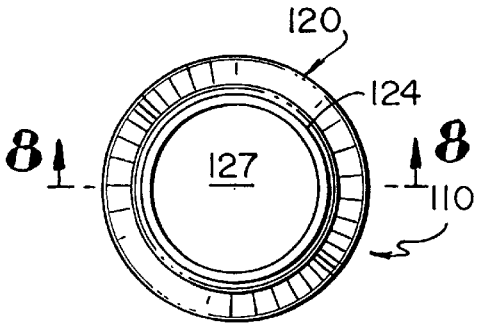
FIG. 7 is a top view of the accordion shaped neck in an alternate embodiment without the inwardly disposed locking mechanism.
Figure 8:
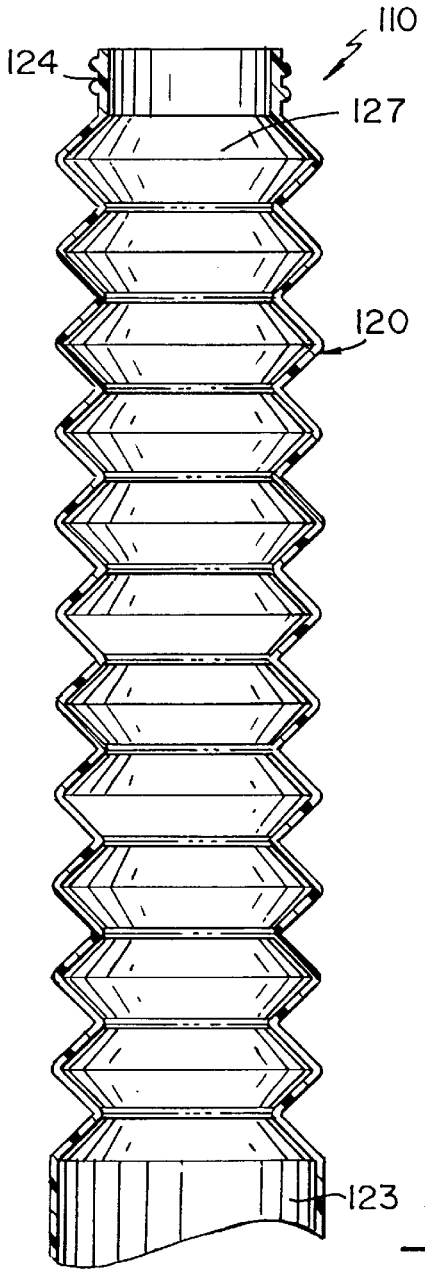
FIG. 8 is a partial elevational cross-sectional view of the embodiment illustrated in the previous figure, taken along line 8—8.

FIGS. 7 and 8 illustrate alternate embodiment 110 with elongated tubular accordion shaped neck 120 in extended position. Similar to embodiment 10, elongated tubular neck 120 includes lower tubular portion 123 that is connected to a container and upper threaded tubular member 124 to cooperatively receive a threaded cap. Elongated tubular neck 120 has through opening 127 to permit the contained liquid to travel through without any obstacles. Embodiment 110 does not include plates 32 and 32' mounted thereto.

Figure 9:
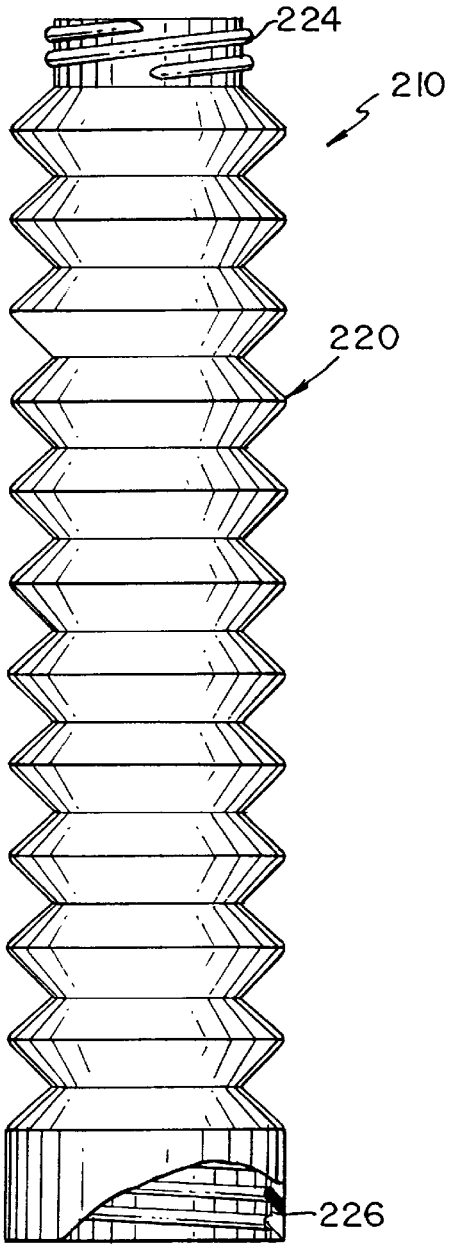
FIG. 9 is an elevational view of another alternate embodiment of an accordion shaped neck and showing a partial cross section of the lower threaded end thereof.

FIG. 9 illustrates alternate embodiment 210. Embodiment 210 basically includes elongated tubular accordion shaped neck 220 with threaded ends 224 and 226. Threaded end 226 is a tubular member with threads inwardly disposed that permits a user to removably mount elongated tubular accordion shaped neck 220 to a container. In this manner, a user can readily pour out the content into another reservoir without the need of a funnel.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A device for containers containing liquids and having an upper opening, comprising an elongated tubular neck having an accordion shape having inner and outer annular rims wherein said elongated tubular neck includes first and second ends and a through opening, said first end has a tubular member adapted to be rigidly mounted to said upper opening and said second end has a threaded tubular member to cooperatively receive a threaded cap thereto, and said elongated tubular neck has sufficient length so that a user can extend it and locate said second end next to a reservoir so that said liquid content can be transferred from said container to said reservoir, and wherein said device further comprises locking means mounted to the internal walls of said elongated tubular neck, and said locking means includes a plurality of plates radially extended and inwardly mounted to said internal walls of said annular inner rims, said plurality of plates are cooperatively disposed to cover said through opening when at least one protuberance located in one of said plurality of plates cooperatively engages within a cavity located in another adjacent plate of said plurality of plates, wherein said locking means keeps said elongated tubular member in compressed position.

* * * * *